US005099999A

United States Patent [19]

Balien

[11] Patent Number: 5,099,999

[45] Date of Patent: Mar. 31, 1992

[54] PILL SAFETY DISPENSER

[76] Inventor: J. Lewis Balien, 903 Mercer Ave., Bloomington, Ill. 61701

[21] Appl. No.: 710,958

[22] Filed: Jun. 6, 1991

[51] Int. Cl.[5] ..... B65D 85/42

[52] U.S. Cl. ..... 206/536; 221/152; 221/190

[58] Field of Search ..... 206/536, 537, 528, 540, 206/533; 221/152, 190

[56] References Cited

U.S. PATENT DOCUMENTS

| | | | |
|---|---|---|---|
| 2,808,150 | 10/1957 | Schlesser | 206/533 |
| 3,027,000 | 3/1962 | Kantrow | 206/536 |
| 4,784,288 | 11/1988 | Jennings | 206/536 |
| 4,854,478 | 8/1989 | Gyimothy | 221/190 |
| 4,971,203 | 11/1990 | Weinstein | 206/536 |
| 5,052,584 | 10/1991 | Dubach | 221/152 |

FOREIGN PATENT DOCUMENTS

| | | | |
|---|---|---|---|
| 277476 | 8/1951 | Switzerland | 206/536 |

*Primary Examiner*—William I. Price

*Attorney, Agent, or Firm*—JoAnne M. Denison; James M. Wetzel; Jon Carl Gealow

[57] ABSTRACT

An easy to use pill safety dispenser having few parts and which are easily manipulated even by persons with digital disabilities such as arthritis and paralysis. The dispenser consists of a axially arranged cylindrical pill container having a pill dispensing aperture in its sidewall and a row of slots or notches positioned at one end of the outer rim of the container. One notch is deeper than the others. A corresponding sleeve with a pill dispensing aperture is adapted to fit over the container which is rotatable and slidable and has a tang positioned near one of its ends which, when correctly rotated and slid into position, aligns both pill dispensing apertures and allows one or more pills to pass through.

3 Claims, 1 Drawing Sheet

PILL SAFETY DISPENSER

BACKGROUND OF THE INVENTION

This invention relates to the area of pill dispensers, and more specifically to the field of pill dispensers having mechanisms for preventing tampering by children. Although there are numerous containers on the market and numerous patents disclosing the use of tamper preventative mechanisms, virtually all of these are difficult to use by persons with limited hand mobility or they employ relatively complex mechanisms which are more difficult and more expensive to manufacture.

For example, although U.S. Pat. No. 3,027,000 discloses a container which is child tamper resistant, the dispenser requires numerous pieces having slots, bevels and ridges in order to make the dispenser work. And, although U.S. Pat. No. 4,784,288 discloses the use of a tamper evident container, the container is easy to open with one hand and is not child resistant. Also, this particular device is fairly complex in construction and requires the use of numerous bevels, tangs, flanges and complex ridges and slots in order to make it easily manipulated by one hand. Also the container is not refillable and must be discarded after all pills are used up.

Pill dispensers commonly provided with prescription drugs are very difficult to manipulate and require either excessive downward force to engage a series of ratchets which allow the lid to be turned to be removed, or the dispenser requires excessive upward force to turn the lid and remove it.

The present invention overcomes all of these disadvantages by providing a very simple, two or three piece device which is refillable and reusable, easy to manipulate and simple in construction and design making it readily and commercially marketable at extremely low cost.

SUMMARY OF THE INVENTION

The present invention comprises a cylindrical pill containing compartment and a sleeve adapted to fit over the compartment, with both having cylindrical sidewalls containing a pill dispensing aperture. The pill container has a row of notches or depressions along one of its lower edges, with one notch being deeper than the rest, and the sleeve has a corresponding tang depending from one edge of its sidewall such that when the sleeve is rotated and the tang is aligned and slid into the deeper notch, the pill dispensing apertures will become aligned so as to allow the dispensing of one pill.

The design of the pill dispenser is very simple such that it can be made from two or three pieces, depending on whether a removable lid is desired for easier refilling. Moreover, there are no complex internal structures such as a series of baffles or chambers nor are there numerous complex assemblages of slots, flanges, bevels, etc. required to make the dispenser child resistant. Also the sleeve can be fitted onto the pill containing chamber such that it is easy to slide and rotated by individuals who have limited hand mobility.

Thus, it is one primary object of the present invention to provide a child resistant pill dispenser which is simple in design and construction allowing it to be readily and cheaply manufactured from plastic or other polymeric compounds.

It is also a primary object of the present invention to provide a child resistant pill dispenser which can be easily rotated and slid by persons of limited hand mobility in order to dispense the medication contained therein.

And, it is yet a further primary object of the present invention to provide a child resistant pill dispenser which is easily reusable and refillable so as to provide economy of use.

These and other objects, features and advantages of the present invention may be readily ascertained from the accompanying drawings and detailed description of the invention.

DETAILED DESCRIPTION OF THE DRAWINGS

Figure 1:
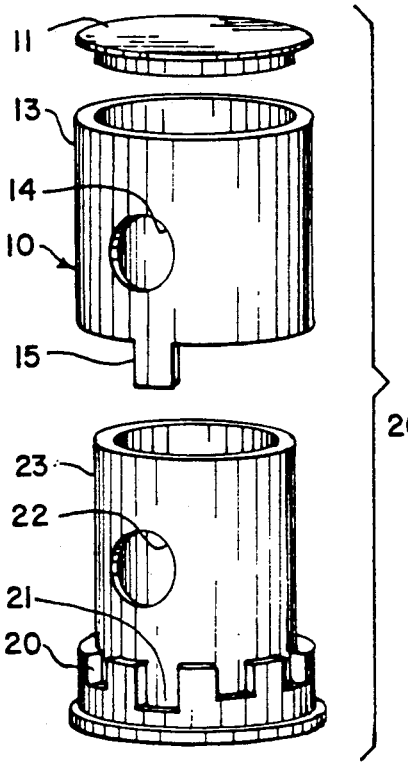
FIG. 1 shows a exploded perspective view of a first embodiment of the pill dispenser.
Figure 2:
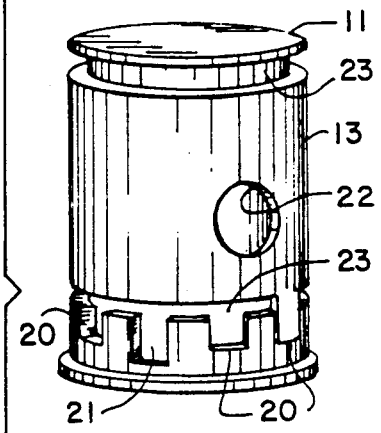
FIG. 2 shows a perspective view of the pill dispenser in its closed or "locked" condition.
Figure 3:
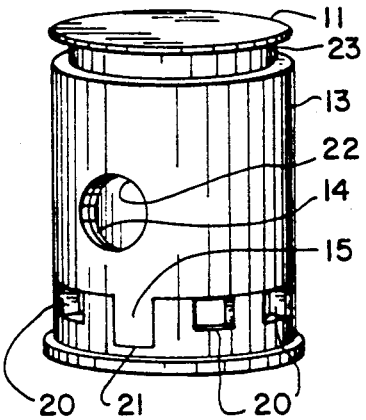
FIG. 3 shows a perspective view of the pill dispenser with the tang fully engaged and the dispenser apertures aligned and open.

Referring now to FIGS. 1 through 3 of the drawings in detail, the reference character 10 indicates the first preferred embodiment of the container and safety mechanism according to the invention. As shown in FIG. 1, container 10 is broken up into three main components, the cylindrical sleeve 13 which is adapted to snugly fit over cylindrical pill containing chamber 23, and a lid 11. Pill containing chamber 23 is shown with tight fitting lid 11 which encapsulates the pills or other articles to be secured.

Of course, it is understood that lid 11 is provided for the convenience of the user in being able to load and reload a large quantity of pills at a single time. Since it is the object of the invention to make container 10 resistant to tampering by young children, it is anticipated that lid 11 is tightly fitted into chamber 23 so that it will take an extreme amount of force to remove the lid, or in the alternative, a tool such as a blunt knife or screw driver can be inserted between the lid 11 and the compartment 23 to aid in removal.

Sleeve 13 is shown with pill dispensing aperture 14 and depending tang 15. Chamber 23 also has a corresponding pill dispensing aperture 22 which is located directly above a deep notch 21 located near one end of chamber 23. Tang 15 is adapted to fit into either the plurality of notches located along the bottom of chamber 23 or within the deeper notch 21. However, it is only when tang 15 is rotated and fully seated within deeper notch 21 that the two pill dispensing apertures 14 and 22 become aligned and allow a pill to be dispensed.

FIG. 3 shows assembly 10 in its pill dispensing mode with tang 15 fully seated and engaged within deeper notch 15. Pill dispensing apertures 22 and 14 of both the sleeve 13 and the chamber 23 are now aligned and shown in their pill dispensing position.

Figure 4:
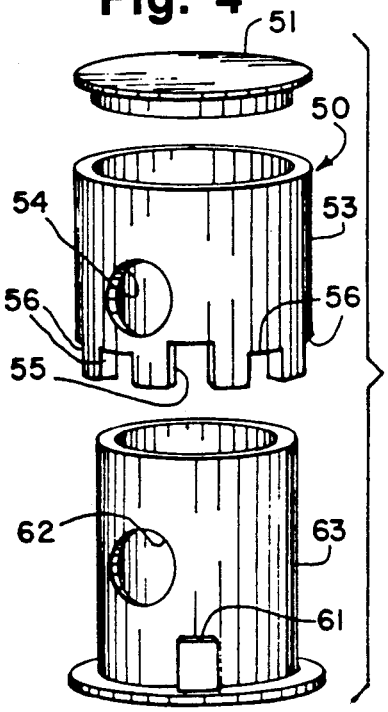
FIG. 4 shows an exploded perspective view of a second embodiment of the pill dispenser.
Figure 5:
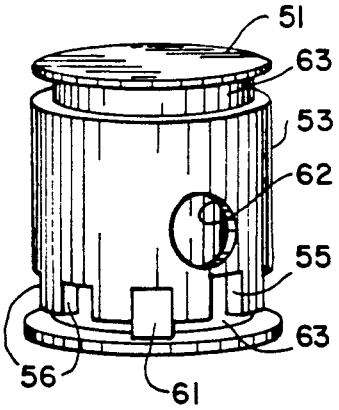
FIG. 5 shows a perspective view of the pill dispenser in its closed or "locked" condition.
Figure 6:
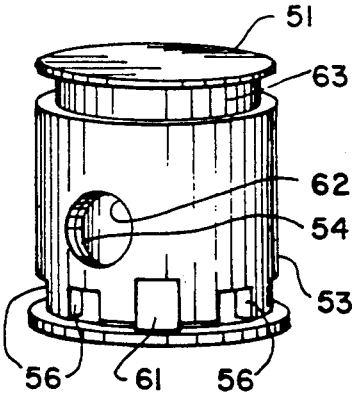
FIG. 6 shows a perspective view of the pill dispenser with the notch fully engaged and the dispenser apertures aligned and open.

Similarly, FIGS. 4 through 6 show the second preferred embodiment of the present invention. Like the first preferred embodiment, reference character 50 refers to the pill dispenser and associated safety mechanism. Like pill dispenser 10, the second preferred embodiment of the pill dispenser 50 has a sleeve 53, pill chamber 63 and tight fitting lid 51. Lid 51 is tightly secured in one end of pill chamber 63 and may only be dislodged by use of a tool or though excessive force.

Like the first preferred embodiment, both the sleeve 50 and the pill chamber 63 have corresponding pill dispensing apertures 62 and 54. However, in this preferred embodiment, the chamber 63 has a raised stop 61 which is adapted to fit into notches 56 and deeper notch 55 which are located along the end of sleeve. In this Way, as shown in FIG. 5, when raised stop 61 is seated in one of a plurality of notches 56 located along one end of sleeve 53, the pill dispensing apertures 62 and 54 are not aligned and a pill cannot pass through. However, FIG. 6 shows raised stop 61 fully engaged in notch 53, allowing pill dispensing aperture 62 and 54 to become aligned so as to dispense one pill.

In this way, when a user is done taking medication, the pill dispenser sleeve can be simply rotated and engaged in one of the numerous slots or notches 56 located on the sleeve. A very young child will have difficulty in opening the dispenser by aligning the notch or tang in the corresponding deeper slot or notch and presumably a child would become frustrated and give up her or his futile attempts at doing so.

Of course, the exact configuration of safety mechanism depicted in the drawings is not all inclusive, and there are numerous other variations which are readily apparent therefrom. For example, although the drawings show notches, tangs and raised stops which are square in configuration, this is not a requirement, and the objects of the invention can be accomplished through use of notches, tangs and stops of differing configurations, such as hemispherical, triangular or pointed, elliptical, etc. Also, although the drawings show the notches as being cut clear through the sleeve so as to be visible to the user, they may also be hidden or cut only partially through or indented within the sidewall so as to require a marking on the sleeve for correct alignment of the sleeve with the chamber. These and other similar variations are considered to be part of the scope of the present invention.

What is claimed is:

1. A safety dispenser having an article containing compartment and a sleeve adapted to fit over the compartment, with both the compartment and the sleeve being cylindrical in shape with depending cylindrical sidewalls, the compartment being closed at either end and the sleeve being open at either end, with both the sleeve and the compartment further having corresponding dispensing apertures formed in each of their sidewalls, with the sleeve further having a tang depending from one of its open ends and the compartment having a series of corresponding notches circumferentially spaced apart near one of its ends with one notch being deeper than the other notches and, when aligned and in seated engagement with the tang of the sleeve, both apertures to become superimposed so as to allow an article to be dispensed from the compartment.

2. A safety dispenser having an article containing compartment and a sleeve adapted to fit over the compartment, with both the compartment and the sleeve being cylindrical in shape with depending sidewalls, the compartment being closed at either end and the sleeve being open at either end, with both the sleeve and the compartment further having corresponding dispensing apertures formed in each of their sidewalls, with the compartment further having a notch stop formed near one of its ends and the sleeve further having a corresponding series of notches circumferentially spaced apart along one of its ends with one notch being deeper than the other notches and, when aligned and in seated engagement with the notch stop of the compartment, both apertures become superimposed so as to allow an article to be dispensed from the compartment.

3. The article dispenser of claims 1 or 2 wherein at least one end of the compartment further has a removable lid.

* * * * *

UNITED STATES PATENT AND TRADEMARK OFFICE

CERTIFICATE OF CORRECTION

PATENT NO. : 5,099,999

DATED : March 31, 1992

INVENTOR(S) : J. Lewis Bailen

It is certified that error appears in the above-identified patent and that said Letters Patent is hereby corrected as shown below:

At. col 3, line 14, please delete [Way] and insert way.

Signed and Sealed this

Seventh Day of September, 1993

Bruce Lehman

*Attest:*

BRUCE LEHMAN

*Attesting Officer*

*Commissioner of Patents and Trademarks*